US005586914A

United States Patent [19]

Foster, Jr., deceased et al.

[11] Patent Number: 5,586,914

[45] Date of Patent: Dec. 24, 1996

[54] ELECTRICAL CONNECTOR AND AN ASSOCIATED METHOD FOR COMPENSATING FOR CROSSTALK BETWEEN A PLURALITY OF CONDUCTORS

[75] Inventors: George H. Foster, Jr., deceased, late of Winston-Salem, N.C., by Alice M. Foster, executrix; Donald L. Metzger, Harrisburg, Pa.

[73] Assignee: The Whitaker Corporation, Wilmington, Del.

[21] Appl. No.: 444,501

[22] Filed: May 19, 1995

[51] Int. Cl.[6] ..... H01R 23/02; H01R 4/24

[52] U.S. Cl. ..... 439/676; 29/827; 29/883; 29/884; 439/941

[58] Field of Search ..... 29/749, 883, 884, 29/827; 439/676, 404, 941

[56] References Cited

U.S. PATENT DOCUMENTS

| | | | |
|---|---|---|---|
| 4,806,117 | 2/1989 | Johnston | 439/676 |
| 4,975,078 | 12/1990 | Stroede et al. | 439/676 |
| 5,096,442 | 3/1992 | Arnett et al. | 439/676 |
| 5,186,647 | 2/1993 | Denkmann et al. | 439/395 |
| 5,226,835 | 7/1993 | Baker, III et al. | 439/409 |
| 5,310,363 | 5/1994 | Brownell et al. | 439/941 |
| 5,362,257 | 11/1994 | Neal et al. | 439/676 |
| 5,403,200 | 4/1995 | Chen | 439/676 |

FOREIGN PATENT DOCUMENTS

| | | | |
|---|---|---|---|
| 0598192A1 | 5/1994 | European Pat. Off. | H01R 23/02 |
| WO94/21007 | 9/1994 | WIPO | H01R 13/719 |

OTHER PUBLICATIONS

International Search Report in International Application No. PCT/US96/04628.

*Primary Examiner*—Stephen P. Garbe

[57] ABSTRACT

An electrical connector which provides compensation for crosstalk includes a number of conductors positioned at least partially within an internal cavity defined by a housing. The elongate conductors are generally substantially parallel and laterally spaced and include a resilient contact portion at a first end and an insulation displacement contact portion at a second end. The elongate conductors include a pair conductors, at least a portion of which are positioned in an overlapping, vertically spaced relationship. The portions of the pair of conductors which overlap are generally wider than the substantially parallel, laterally spaced portions of the conductors so as to thereby define respective compensating segments. The length of the compensating segments as well as the width of the portion of the compensating segments which overlap can be selected to establish capacitive coupling between the compensating segments so as to thereby compensate for crosstalk between the conductors.

23 Claims, 9 Drawing Sheets

10
14
26
24
36
42
28
29
40
18
20
22
16
38
44
32
64
34
30

ELECTRICAL CONNECTOR AND AN ASSOCIATED METHOD FOR COMPENSATING FOR CROSSTALK BETWEEN A PLURALITY OF CONDUCTORS

FIELD OF THE INVENTION

The present invention relates to an electrical connector and, more particularly, to an electrical connector having a plurality of conductors and which compensates for crosstalk between the conductors.

BACKGROUND OF THE INVENTION

A number of electrical connectors include a plurality of elongate conductors which electrically interconnect respective inputs and outputs of the connector. As known to those skilled in the art, an elongate conductor which is adjacent to or relatively near another elongate conductor will typically experience crosstalk. As explained in more detail hereinafter, crosstalk is generally defined as the unwanted coupling or transmission of an electrical signal from one pair of wires to another nearby pair of wires. Crosstalk occurs by inductive (magnetic field) coupling and by capacitive (electric field) coupling. In addition, increased levels of crosstalk are established between conductors which extend in a parallel or near-parallel relationship, such as the elongate conductors of many electrical connectors.

Crosstalk is generally undesirable as the integrity and definition of the signals transmitted via the conductor is impaired by the interfering coupled signals. In addition, the strength of the signals transmitted via the respective conductor is also typically reduced by the energy expanded or wasted in crosstalk, particularly at relatively high frequencies. Therefore, various methods have been employed to reduce or compensate for crosstalk, particularly within electrical connectors which include a plurality of elongate conductors.

For example, in a number of multi-conductor cables, the conductors are arranged in conductor pairs. In instances in which substantial capacitive and inductive coupling occurs between two pairs of conductors, crosstalk between the conductor pairs can reach an undesirable level. Thus, one goal in circuit design is to reduce the coupling between conductor pairs, such as by twisting the wire which forms each conductor pair or by separating the previously coupled conductor pairs. Notwithstanding the twisting of the wires of a conductor pair or the separation of the conductor pairs, crosstalk can still occur. This additional crosstalk typically results from the unbalanced nature of the conductors. More specifically, conductors are generally termed unbalanced in instances in which the coupling between a first conductor of a first conductor pair to each of the conductors and a second conductor pair is not equal.

This additional crosstalk can be reduced by requiring the coupling between the first conductor of the first conductor pair and both of the conductors of the second conductor pair to be equal. This additional crosstalk can be further reduced by requiring the coupling from the second conductor of the first conductor pair to both of the conductors of the second conductor pair to be equal and, furthermore, to be the same as a coupling between the first conductor of the first conductor pair and the conductors of the second conductor pair. As known to those skilled in the art, this balanced relationship can be represented by a bridge circuit having four nodes interconnected by capacitors, each having the same capacitance. Furthermore, this balanced relationship effectively reduces crosstalk since the signals coupled between the first and second conductor pairs will offset or cancel one another.

In a number of local area networks, however, the signals transmitted via the first and second conductors of a conductor pair are differential signals, that is, the signal on a first conductor of a conductor pair is the inverse or opposite of the signal on the second conductor of the conductor pair. Due to the inversion of the signals, each conductor of a conductor pair radiates a crosstalk signal having a different polarity. In order to reduce the crosstalk, the crosstalk signals radiated by the conductors of the first conductor pair must be equal to the crosstalk signals radiated by the conductors of a second conductor pair so as to cancel or offset without affecting the signal of the second conductor pair. In order to provide such cancellation or offsetting, the differential signals must be carefully adjusted in strength so that they will cancel or balance the nearby conductor pairs. By adding small amounts of capacitive coupling, the undesirable coupling can be balanced or compensated and the desired balanced or nulling effect can be achieved. However, the careful adjustment of the differential signals and the utilization of capacitive coupling generally increases the complexity of the multi-conductor cable and the signal transmission network.

One common type of connector is a 110-type connector which generally interconnects one or more connectors of a multi-conductor cable, such as a telecommunications cable, and a telecommunications device, such as a telephone, a computer or a facsimile machine. A 110-type connector can include a printed circuit board defining a predetermined number of conductive traces which provide an interface between the multi-conductor cable and the telecommunications device. A plurality of insulation displacement contacts are typically connected directly to respective conductive traces defined on the printed circuit board and are positioned to extend in a generally perpendicular direction to the surface of the printed circuit board. Each insulation displacement contact includes a pair of substantially planer, opposed blade portions which define an insulation displacement slot therebetween.

A 110-type connector also generally includes a plurality of spring contacts which are preferably connected to respective conductive traces defined on the printed circuit board and which extend laterally outward therefrom. Thus, a spring contact and an insulation displacement contact are generally connected to the opposed first and second ends of each conductive trace, respectively. The plurality of spring contacts are generally positioned within a modular jack housing or other data interface assembly which has an opening sized to receive a mating plug so as to thereby be electrically connected with the telecommunications device. Crosstalk between the conductive traces of a 110-type connector is controlled by minimizing or balancing magnetic loops which transmit the inductive component of the interfering signal and by minimizing or balancing the capacitive coupling which transmits the electric field component of the interfering signal.

In use, conductors of the multi-conductor cable are individually inserted into the insulation displacement slots defined by the respective insulation displacement contacts, such as with an impact tool. Common impact tools include those manufactured and sold by AT&T and Krone which have Model Nos. Harris-Dracon D-814 and LSA-PLUS #6417 2 055-01, respectively. More specifically, a predetermined force, typically a vertically downwardly directed force, must be applied, such as with an impact tool, to insert each conductor into the respective insulation displacement slot such that the insulating covering of the conductor is slit by the opposed blade portions and electrical contact is established with the conductor.

During application of the required insertion force, a 110-type connector must generally be supported by a firm surface to prevent relative movement of the 110-type connector and the resulting misalignment of the conductor and the respective insulation displacement contact. Thus, the conductors must generally be inserted into the respective insulation displacement slots prior to the insertion of the 110-type connector into a wall plate or face plate.

More specifically, a 110-type connector is typically inserted into a wall plate such that the opening defined through the wall plate to receive the mating plug is readily accessible, as known to those skilled in the art. Thus, the wall plate will not necessarily provide a firm support surface during the application of the insertion force since the printed circuit board of the connector generally extends perpendicular to the wall plate such that the insertion force is directed generally parallel to the wall plate. Accordingly, the wiring and rewiring of a 110-type connector is complicated since the connector is generally installed after inserting the conductors into the insulation displacement slots and must typically be removed from the wall plate prior to adding to or changing the wiring pattern.

Another electrical connector which has been developed to reduce crosstalk is described in U.S. Pat. No. 5,186,647 which issued Feb. 16, 1993 to W. John Denkmann, et al. and is assigned to AT&T Bell Laboratories (hereinafter the "'647 patent"). The high frequency electrical connector of the '647 patent includes a number of conductors mounted on a dielectric surface and extending in a generally parallel relationship for at least a portion of their length. At least one of the elongate conductors crosses the path of another conductor without making electrical contact therebetween to reduce the crosstalk between the conductors.

In particular, each elongate conductor of the high frequency electrical connector of the '647 patent includes a spring contact at a first end and an insulation displacement contact at a second end, opposite the first end. The elongate connectors are folded about a spring block and a cover is placed over and joined to the spring block to protect the conductive elements. The spring block includes a tongue-like portion which can be inserted into a jack frame which engages the cover to form a protective housing. The jack frame is adapted for insertion into a wall plate and includes an opening that is adapted to receive a modular plug for interconnecting a telecommunications device with the respective conductors of a multi-conductor cable.

Once the elongate conductors of the electrical connector of the '647 patent have been folded about the spring block and the cover has been placed thereover, the conductors of a multi-conductor cable can be individually inserted into the insulation displacement slots defined by the respective insulation displacement contacts, such as with an impact tool. As explained above in conjunction with other 110-type connectors, the electrical connector must generally be supported by a relatively firm surface during insertion of the conductors into the respective insulation displacement slots in order to prevent relative movement of the electrical connector and to maintain alignment of the conductors with respect to the insulation displacement slots.

In addition, due to the folding of the insulation displacement contacts of the high frequency electrical connector of the '647 patent about the sidewalls of the spring block, the force required to insert the conductors into respective insulation displacement contacts is directed generally parallel to the wall plate in which the jack frame is mounted. Therefore, the wall plate does not generally provide a sufficiently firm surface to support the electrical connector during insertion of the conductors in the respective insulation displacement slots. Thus, the conductors must also be generally inserted into respective insulation displacement slots prior to mounting the jack frame into the wall plate thereby complicating the wiring and rewiring of the electrical connector since the jack frame must be removed from the wall plate prior to adding to or changing the wiring pattern.

As is also known to those skilled in the art, the conductive elements of the modular plug which are received by the modular jack of the high frequency electrical connectors of the '647 patent are arranged in a first predetermined order. In addition, the conductors of the multi-conductor cable are generally arranged in conductor pairs, referred to as balanced pairs. Each balanced or conductor pair forms one circuit of a data or telephone transmission path. Crosstalk or interference between adjacent circuits in the same cable is undesirable. The conductor pairs are typically color-coded such that a technician can identify the individual conductors of each conductor pair. The conductor pairs are also generally twisted to further reduce crosstalk between the conductor pairs. In order to ensure that predetermined conductors of the multi-conductor cable are electrically connected to predetermined conductive elements of the plug, each conductor of the multi-conductor cable must be inserted into a predetermined insulation displacement slot.

The high frequency electrical connector of the '647 patent, however, does not arrange the insulation displacement contacts such that the predetermined insulation displacement slots in which each conductor of a conductor pair is inserted are adjacent. Thus, end portions of the conductors of the multi-conductor cable must be un-twisted in order to be inserted in the predetermined insulation displacement slots. By un-twisting at least an end portion of the conductors, crosstalk between the conductor pairs increases. Further, by requiring the conductors of a conductor pair to be inserted in remote, i.e., non-adjacent, insulation displacement slots, a technician must pay increased attention to the conductors to ensure that the conductors are inserted in the proper insulation displacement contact slots. Accordingly, the efficiency or speed with which an electrical connector is wired or rewired is diminished.

SUMMARY OF THE INVENTION

It is therefore an object of the present invention to provide an improved electrical connector.

It is another object of the present invention to provide an electrical connector which compensates for crosstalk between a number of conductor pairs.

It is a further object of the present invention to provide a compact electrical connector which can be efficiently wired and rewired.

These and other objects are provided, according to the present invention, by an electrical connector which includes a housing defining an internal cavity, and a plurality of elongate conductors positioned at least partially within the cavity and including a pair of conductors positioned in an overlapping, vertically spaced relationship to compensate for crosstalk between the conductors. According to one embodiment, the conductors also include first and second elongate conductors which extend in a substantially parallel, laterally spaced relationship from their respective first ends to a predetermined crossover location. At the crossover location, the first and second conductors laterally cross without establishing electrical contact therebetween. The crossover location is spaced apart from the predetermined location at which the pair of the conductors are positioned in the overlapping, vertically spaced relationship. By laterally crossing the first and second elongate conductors and by positioning at least a pair of the conductors in an overlapping, vertically spaced relationship, the electrical connector of the present invention compensates for crosstalk between the plurality of conductors.

According to one embodiment of the present invention, the portions of the plurality of elongate conductors which extend in a substantially parallel, laterally spaced relationship, such as between the respective first ends of the elongate conductor of one embodiment and the crossover location, have a predetermined width. Further, the portions of the pair of conductors which are positioned in an overlapping, vertically spaced relationship are wider than the predetermined width of the plurality of conductors to thereby define respective compensating segments. The compensating segments preferably overlap for a predetermined distance in the vertically spaced relationship to establish capacitive coupling therebetween.

According to one embodiment, first and second pairs of the conductors are positioned in respective overlapping, vertically spaced relationships at predetermined locations between the crossover location and the second ends of the respective conductors. Preferably, the first and second pairs of overlapping conductors are the laterally innermost conductors since such innermost conductors generally require increased crosstalk compensation.

The distances defined by each of the elongate conductors between the crossover location and their respective first and second ends, respectively, are equal according to one embodiment. In addition, each of the plurality of elongate conductors preferably extend in the substantially parallel, laterally spaced relationship from their respective first ends to their respective crossover locations according to another embodiment. According to this embodiment, each conductor crosses an adjacent conductor at a crossover location without establishing electrical contact therebetween. In order to ensure that no electrical contact is established at the predetermined crossover location, the portions of the first and second conductors which cross are preferably coated with an insulating coating. In addition, the portions of the pair of conductors positioned in an overlapping, vertically spaced relationship can also be coated with insulating coating. By coating the overlapping pair of conductors with an insulating coating, the vertical spacing between the conductors can be minimized.

The housing of the electrical connector includes a front surface through which the internal cavity opens. The housing also includes a rear surface, opposite the front surface, which defines a plurality of apertures extending into the external cavity. Further, each of the elongate conductors has a resilient contact portion at a first end and an insulation displacement contact portion at a second end, opposite the first end. The insulation displacement contact portion of each elongate conductor extends through a respective aperture defined in the rear surface of the housing.

According to one embodiment, the respective first ends of the plurality of elongate conductors are arranged in a first predetermined order. According to this embodiment, at least one of the plurality of conductors laterally crosses another of the plurality of conductors at a location between the crossover location and the second end of a conductor such that the respective second ends of the plurality of conductors are arranged in a second predetermined order. Preferably, the second predetermined order is arranged such that the pairs of conductors comprising the multi-conductor cable are inserted into adjacent insulation displacement contact portions. Accordingly, the pairs of conductors can remain twisted to a location near the electrical connector to further reduce the crosstalk between the conductors.

According to another embodiment, the housing also includes a plurality of outwardly projecting silos extending rearwardly from the rear surface. The plurality of silos are positioned to project outwardly from portions of the rear surface between the plurality of apertures. More particularly, the plurality of apertures defined in the rear surface of the housing are preferably arranged in two, laterally extending rows. Each of the laterally extending rows are advantageously defined along opposed sides of the rear surface of the housing.

According to this embodiment, the insulation displacement contact portion of each of the plurality of conductors which extends through a respective aperture defined in the rear surface of the housing also extends between a pair of adjacent silos. The insulation displacement contact portion includes a pair of opposed blade portions defining an insulation displacement slot therebetween. Accordingly, a wire can be inserted into the insulation displacement slot by application of a forwardly directed force to the wire, that is, a force directed generally in a direction from the rear surface of the housing to the front surface of the housing.

Accordingly, the electrical connector of the present invention can be installed in a wall plate or face plate prior to inserting the conductors into the respective insulation displacement slots since the forwardly directed force required to insert the conductors is supported by the electrical connector and the associated wall plate. Thus, the wiring and rewiring of the electrical connector is simplified.

According to one aspect of the present invention, the plurality of conductors are formed by a plurality of lead frames of a lead frame assembly. Each lead frame includes at least one elongate conductor extending from a first end connected to a first side of the lead frame to a second end connected to a second side of the lead frame, opposite the first side. The lead frame assembly also includes alignment means for aligning the plurality of lead frames such that the conductors of the plurality of lead frames include first and second elongate conductors which extend in a substantially parallel, laterally spaced relationship from their respective first ends to a predetermined crossover location. At the crossover location, the first and second conductors laterally cross without electrical contact therebetween. In addition, the plurality of lead frames are aligned such that at least a pair of conductors are positioned in an overlapping, vertically spaced relationship at a predetermined location spaced apart from the crossover location. In one embodiment, the plurality of lead frames are coated with an insulating coating to reduce the spacing between the elongate conductors.

DETAILED DESCRIPTION OF THE PREFERRED EMBODIMENTS

The present invention will now be described more fully hereinafter with reference to the accompanying drawings, in which a preferred embodiment of the invention is shown. This invention may, however, be embodied in many different forms and should not be construed as limited to the embodiment set forth herein; rather, this embodiment is provided so that this disclosure will be thorough and complete and will fully convey the scope of the invention to those skilled in the art. Like numbers refer to like elements throughout.

Figure 1:
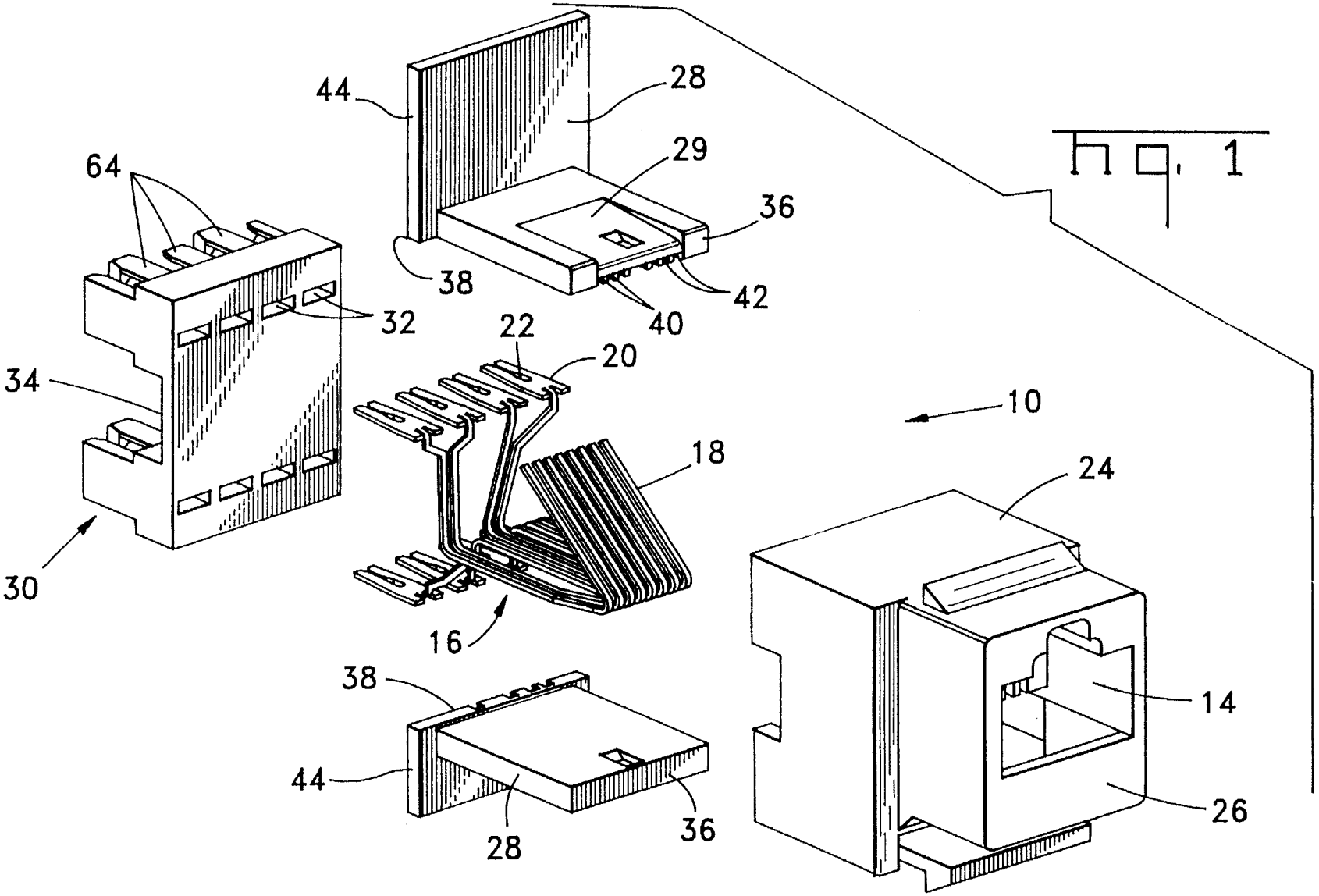
FIG. 1 is a greatly enlarged exploded perspective view of an electrical connector according to the present invention.
Figure 2:
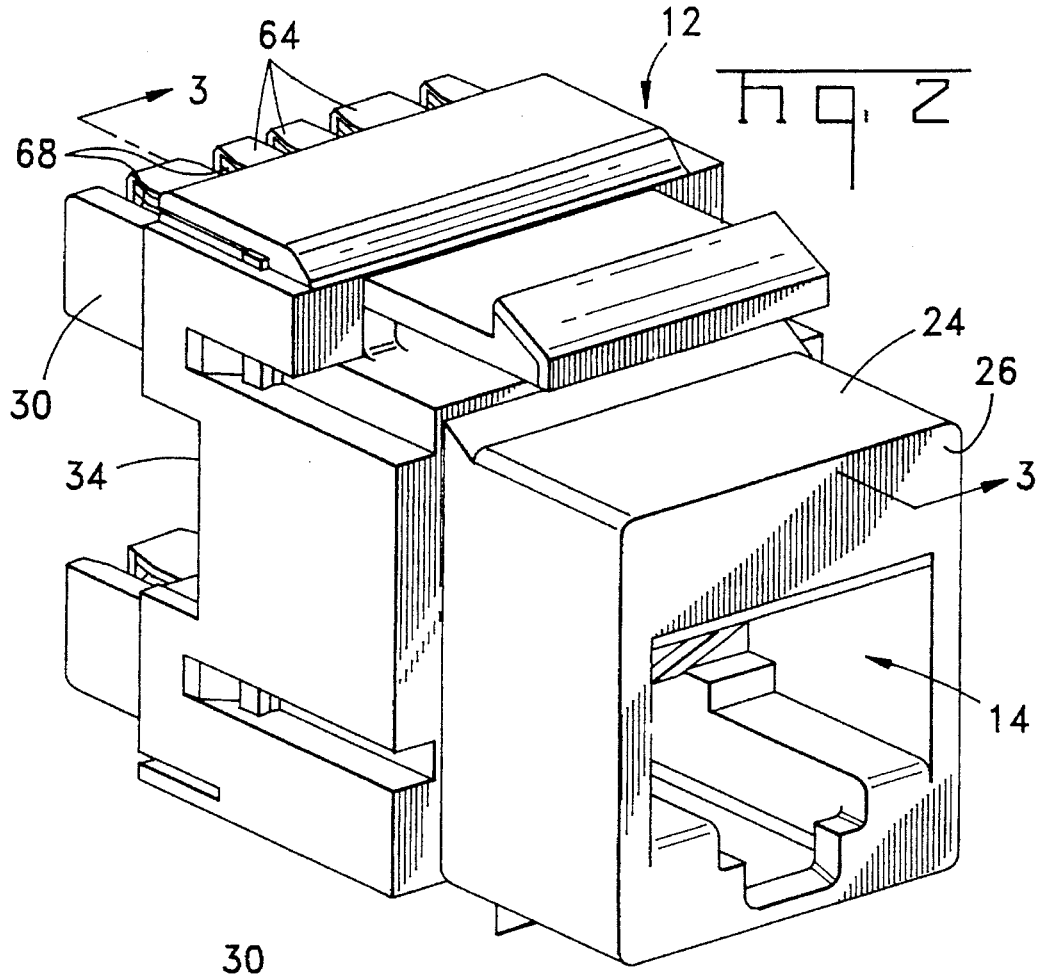
FIG. 2 is a greatly enlarged perspective view of an electrical connector of the present invention illustrating the assembled housing.
Figure 3:
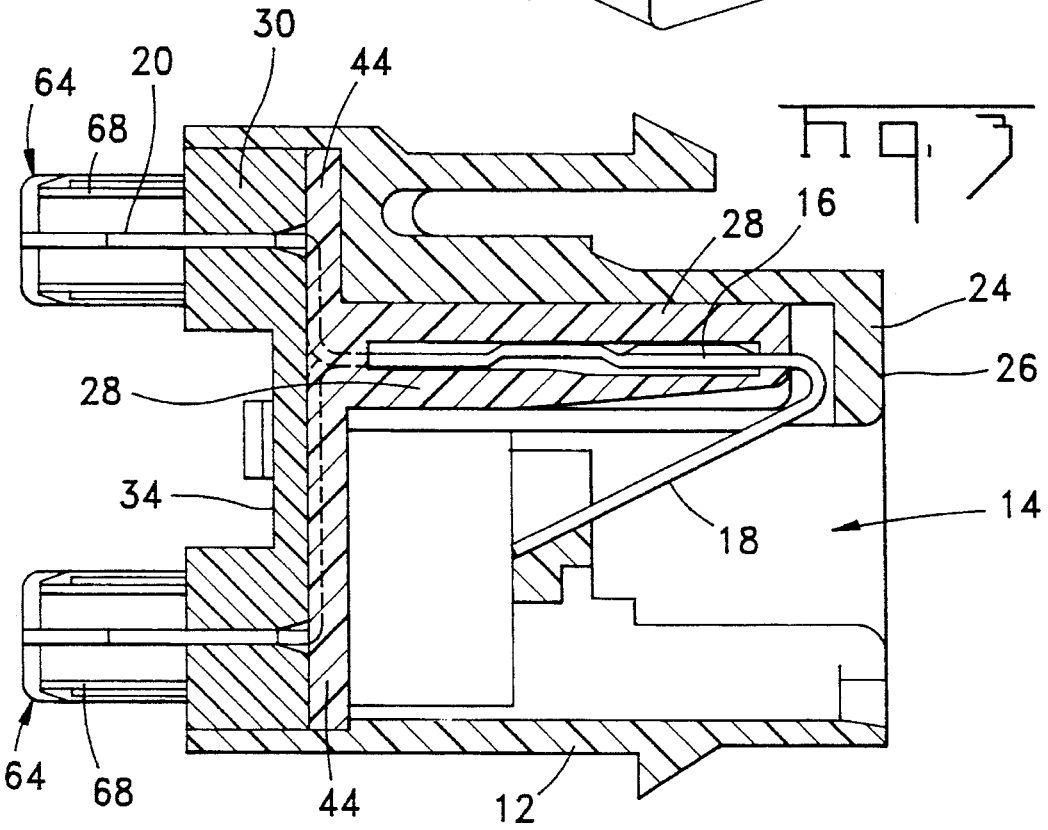
FIG. 3 is a greatly enlarged cross-sectional view of an electrical connector according to the present invention illustrating an elongate conductor and the rearwardly extending silos taken along line 3—3 of FIG. 2.

Referring now to FIGS. 1–3, one embodiment of an electrical connector 10 according to the present invention is illustrated. In particular, the illustrated embodiment of the electrical connector is a modular jack, such as a modular telephone jack, which is adapted to provide electrical connection between the individual conductors of a multi-conductor cable, such as a telecommunications cable and a variety of telecommunications devices, such as telephones, computers and facsimile machines. More specifically, the multi-conductor cable is typically a distribution cable which extends from a telecommunications junction box, or a cross-connect, to an outlet. While a modular telephone jack is illustrated and described herein, the electrical connector of the present invention can be embodied in other types of connectors without departing from the spirit and scope of the present invention.

As illustrated in FIGS. 2 and 3, the electrical connector 10 generally includes a housing 12 defining an internal cavity 14 in which a plurality of elongate conductors 16 are at least partially positioned. Each of the conductors has a resilient contact portion 18 at a first end and an insulation displacement contact portion 20 at a second end, opposite the first end. As shown in further detail in FIG. 1, each insulation displacement contact portion preferably includes a pair opposed blade portions defining an insulation displacement slot 22 therebetween.

The housing 12 is typically comprised of a plastic material, such as polyester resin, to provide a relatively strong and durable structure which is also relatively inexpensive. However, the housing can be comprised of other materials without departing from the spirit and scope of the present invention.

As best illustrated in FIG. 1, the housing 12 is generally comprised of multiple components which can be secured together to form the assembled housing. In particular, the housing of this embodiment includes a housing body 24 defining the internal cavity 14 which opens through a front surface 26 of the housing. As illustrated, the size and shape of the internal cavity and the opening through the front surface of the housing are preferably designed to received a standard telephone plug. The housing also preferably includes first and second supporting members 28 which are inserted into the housing body and are adapted to support and laterally space the elongate conductors 16 as explained in detail below. Finally, the housing preferably includes a strain relief cap 30 which forms the rear surface 34 of the housing. As illustrated, the strain relief cap defines a plurality of apertures 32 extending therethrough.

Figure 4:
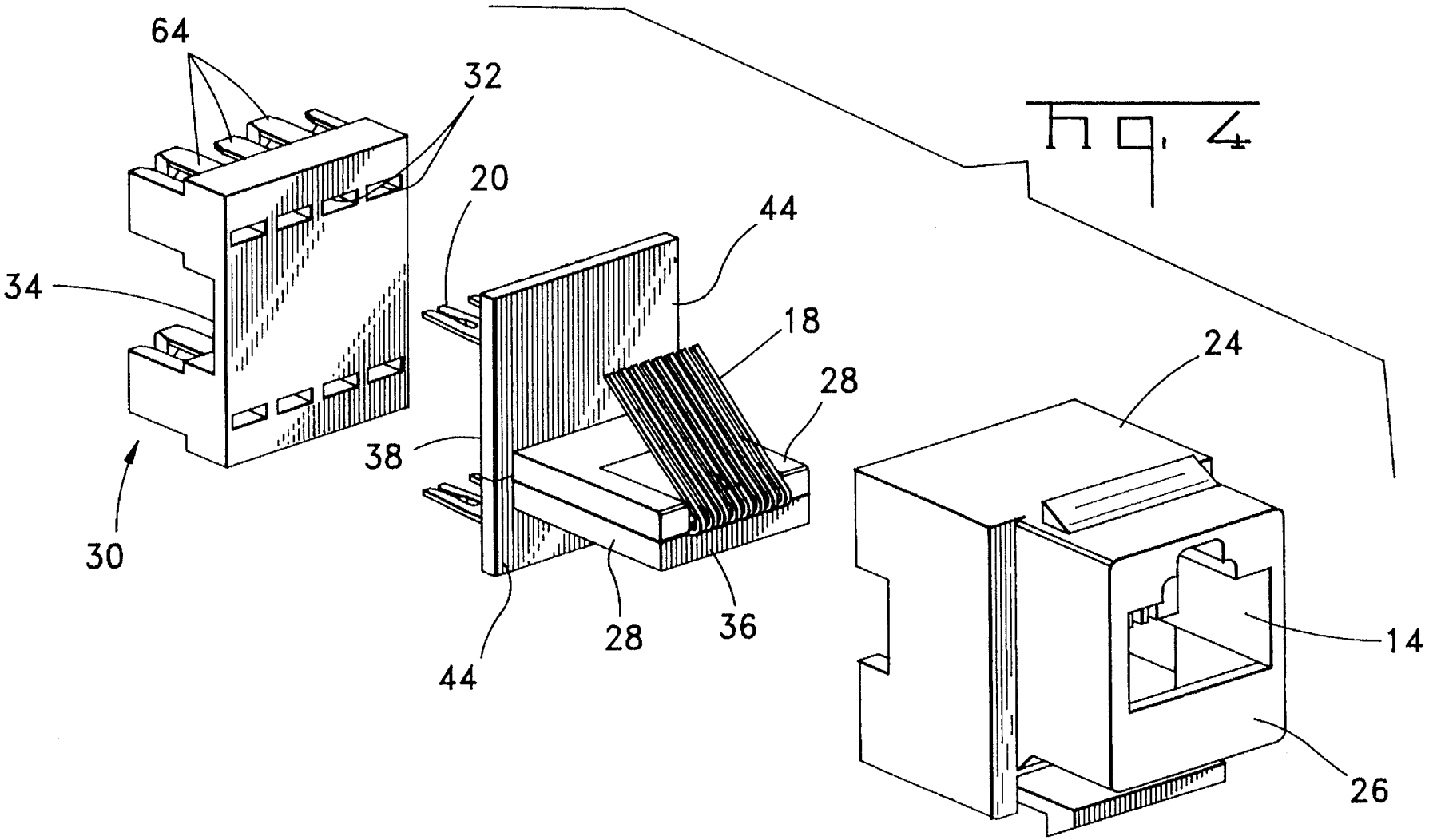
FIG. 4 is a greatly enlarged exploded view of an electrical connector according to the present invention illustrating the relationship of the first and second supporting members and the elongate conductors sandwiched therebetween.

The plurality of elongate conductors 16 are generally positioned between the first and second supporting members 28 such that the respective first ends of the elongate conductors extend from a first side 36 of the first and second supporting members and the respective second ends of the elongate conductors extend from a second side 38 of the first and second supporting members, opposite their respective first sides, as shown in FIG. 4. At least one of the supporting members preferably includes a plurality of ribs 40 extending inwardly between the opposed first and second supporting members. As illustrated in FIG. 1, the first supporting member includes the plurality of inwardly extending ribs, however, the second supporting member can include ribs without departing from the spirit and scope of the present invention. The inwardly extending ribs define a plurality of channels 42 in which the elongate conductors are disposed. Thus, the ribs laterally space the elongate conductors and provide an insulating layer between the conductors to prevent electrical contact therebetween.

As shown in FIG. 4, the first ends of the elongate conductors 16 are generally folded about the first side 36 of the first supporting member 28 to form respective resilient contact portions 18, such as the illustrated spring contacts, for example. As illustrated in FIG. 1, the first supporting member can include a forwardly tapered portion 29 to facilitate the folding of the elongate conductors thereabout.

In addition, the second ends of the plurality of elongate conductors are bent, according to a predetermined pattern, at the second side 38 of the first and second supporting members. As shown in FIGS. 1 and 3, a number of the elongate conductors are bent so as to extend in a generally upward direction while the remainder of the conductors are bent so as to extend in a generally downward direction. According to the illustrated embodiment, one half of the conductors are bent generally upward and one half of the conductors are bent generally downward. The opposed blade portions of the insulation displacement contact portions 20 of the plurality of elongate conductors are also preferably bent so as to extend longitudinally rearward. As illustrated, the first and second supporting members each include an upstanding wall portion 44 which provides a surface to support the bent portions of the elongate conductors.

Once the elongate conductors 16 have been shaped or bent, the plurality of elongate conductors and the first and second supporting members 28 can be inserted into the housing body 24 such that the first ends of the plurality of elongate conductors extend, at least partially, into the internal cavity 14 defined by the housing body. The first and second supporting members and the plurality of conductors sandwiched therebetween, are preferably interlocked with the housing body. For example, in the illustrated embodiment, the first and second supporting members include tapered shoulders which deflect and lock behind complimentary tabs extending from the housing body. However, other means of interlocking the first and second supporting members in the housing body can be employed without departing from the spirit and scope of the present invention.

Thereafter, the plurality of rearwardly extending insulation displacement contact portions 20 can be inserted into respective apertures 32 defined in the strain relief cap 30. The strain relief cap is also preferably interlocked with the housing body 24 to form an integral housing 12. As described above, the opposed side surfaces of the strain relief cap can include respective tapered shoulders which deflect and lock behind a pair of complimentary tabs extending from the housing body.

Due to the folded configuration of the elongate conductors 16 and the size and shape of the housing 12, the electrical connector 10 of the present invention is relatively compact. Thus, the electrical connector can be mounted within wall plates or other fixtures which provide only limited clearance for the connector.

Figures 5, 6:
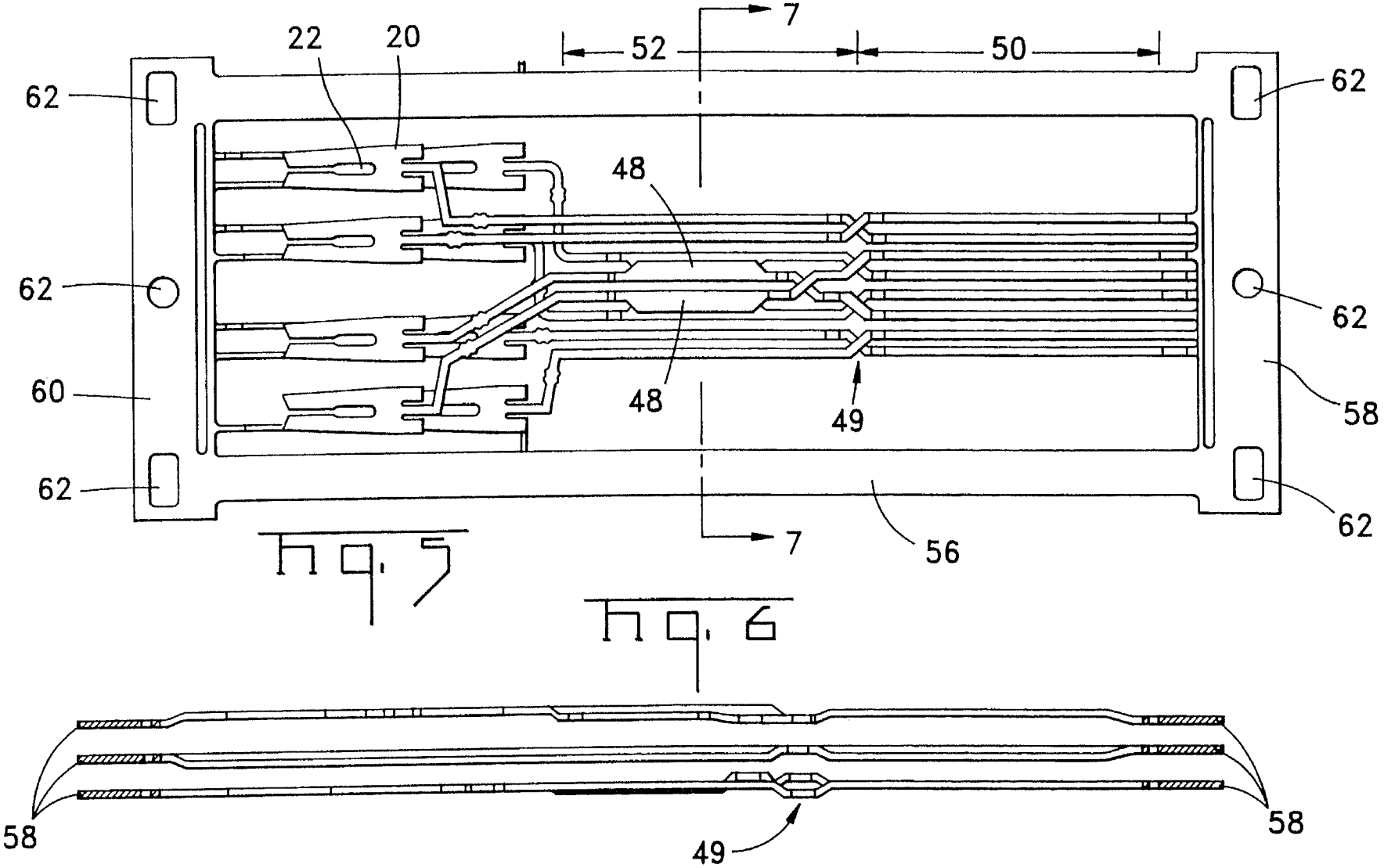
FIG. 5 is a top plan view of a lead frame assembly according to the present invention illustrating a plurality of aligned lead frames.
FIG. 6 is a side view of the lead frame assembly of FIG. 5 illustrating the upper, middle and lower lead frames.

The plurality of elongate conductors 16 of the electrical connector 10 of the present invention are positioned in an adjacent, laterally spaced relationship. Typically, the plurality of elongate conductors also extend substantially parallel as shown in FIGS. 1 and 5. As known to those skilled in the art, adjacent conductors and, in particular, conductors which extend in a substantially parallel relationship suffer from crosstalk between the adjacent conductors.

As best illustrated in FIGS. 5–8 which depict a lead frame assembly 46 including a plurality of elongate conductors 16, the plurality of elongate conductors preferably include a pair of conductors positioned in an overlapping, vertically spaced relationship to compensate for crosstalk between the conductors. Preferably, the first end 18 and, in particular, the resilient contact portion of each elongate conductor has a predetermined width. The overlapping portions of the conductors are advantageously wider than the predetermined width of the end portions of the conductor to thereby define relatively wide compensating segments 48.

Preferably, the pair of elongate conductors 16 are positioned in the overlapping, vertically spaced relationship for a predetermined distance. In addition, only a predetermined portion of their respective compensating segments 48 are preferably overlapped in a vertically spaced relationship so as to establish capacitive coupling therebetween. For example, the overlapping portions of the compensating segments are illustratively shown cross-hatched for clarity in FIG. 8. In particular, the length of the compensating segments as well as the width of the portions of the compensating segments which overlap in a vertically spaced relationship can be selected to optimize the capacitive coupling therebetween and, consequently, to compensate for crosstalk between the conductors. For example, increasing the width of the portions of the compensating segments which overlap in a vertically spaced relationship or increasing the length of the compensating segments increase the capacitive coupling between the compensating segments and provide increased compensation for crosstalk between the conductors.

Figure 7:
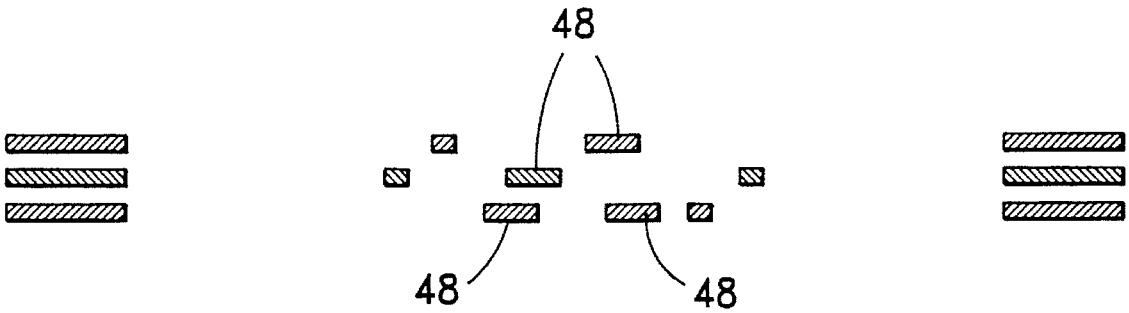
FIG. 7 is a greatly enlarged cross-sectional view of the lead frame assembly of FIG. 5 taken along line 7—7.
Figure 8:
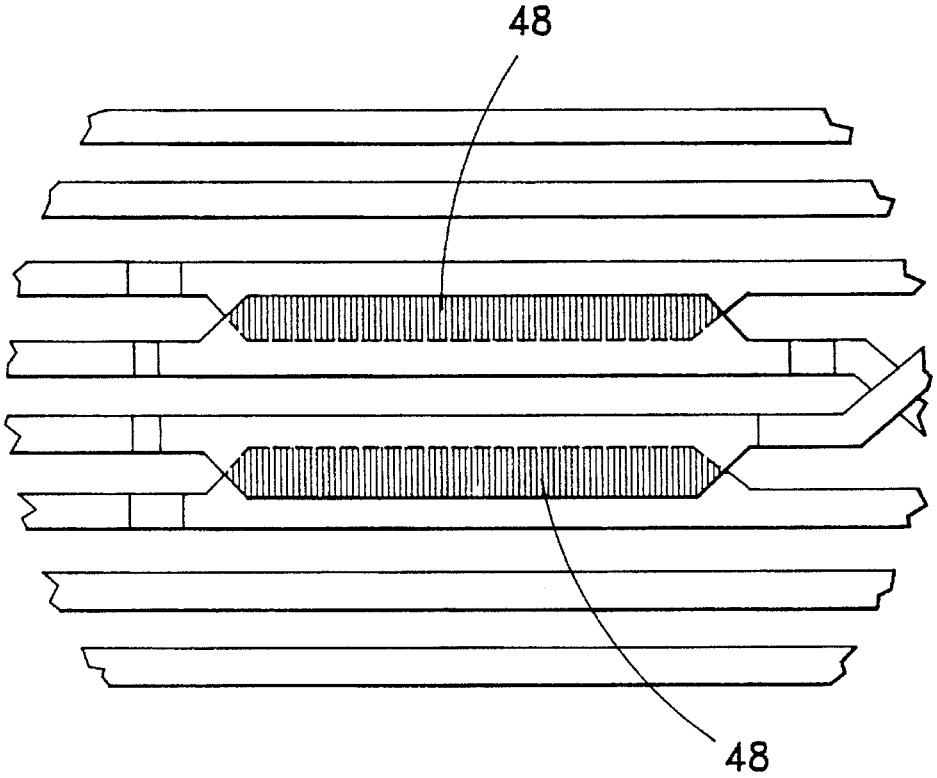
FIG. 8 is a greatly enlarged fragmentary top plan view of the lead frame assembly of FIG. 5 illustrating the overlapping relationship of the compensating segments.

As known to those skilled in the art, the innermost conductors of a plurality of laterally spaced elongate conductors 16 generally experience increased levels of crosstalk in comparison with the outermost elongate conductors. Accordingly, the pair of conductors which include the compensating segments 48 positioned in an overlapping, vertically spaced relationship are preferably an inner pair of conductors. In one embodiment, first and second pairs of elongate conductors are positioned in respective overlapping, vertically spaced relationships. As shown in FIGS. 5, 7 and 8, the first and second pairs of elongate conductors are preferably the laterally innermost conductors which, accordingly, experience increased levels of crosstalk and require additional compensation.

As illustrated in FIGS. 5–8, the plurality of elongate connectors can also include first and second elongate conductors which extend in a substantially parallel, laterally spaced relationship from their respective first ends to a predetermined crossover location 49. At the crossover location, the first and second conductors laterally cross without establishing electrical contact therebetween. Accordingly, by laterally crossing the first and second conductors, additional compensation for crosstalk between the conductors is provided. In particular, the lateral crossing of the conductors is believed to reverse the polarity of the crosstalk between the conductors such that the cumulative effect of the crosstalk is reduced, if not eliminated.

In one embodiment, each elongate conductor 16 laterally crosses another of the elongate conductors at a crossover location 49. In this embodiment, the electrical connector 10 preferably includes a plurality of pairs of elongate conductors which extend in a substantially parallel, laterally spaced relationship from their respective first ends to predetermined crossover locations where one conductor of each conductor pair laterally crosses the other conductor of the conductor pair without establishing electrical contact therebetween. Preferably, the crossover locations of the plurality of pairs of elongate conductors are laterally aligned, such as in a side-by-side relationship.

The position of the crossover location 49 relative to the length of the elongate conductors 16 is preferably selected such that sufficient compensation is provided between the crossover location and the second ends of the respective conductors for crosstalk which occurred, for example, between the respective first ends of the elongate conductors and the crossover location. In one preferred embodiment, the distances 15 defined by each of the conductors between the crossover location and their respective first and second ends, 50 and 52 respectively, are equal.

As described above, the inwardly extending ribs 40 of the first supporting member 28 of the illustrated embodiment laterally spaces and aligns the elongate conductors 16 and prevents electrical contact between adjacent conductors. In addition, in one embodiment, the portions of the first and second conductors which laterally cross at the predetermined crossover location 49 are coated with an insulating coating. Thus, the conductors can be relatively close without establishing electrical contact therebetween. The insulating coating can be polyvinyl formal or polyamide/polyimide, for example. In addition, the compensating segments 48 of the pair of conductors which overlap in a vertically spaced relationship can also be coated with an insulating coating, such as polyvinyl formal or polyamide/polyimide. Therefore, the vertical spacing between the compensating segments can be relatively small without establishing electrical contact between the conductors. Alternatively, in the embodiments of the electrical connector 10 of the present invention in which the compensating segments and the portions of the first and second conductors which laterally cross are not coated with an insulating coating, the conductors, including the compensating segments, are preferably spaced a sufficient distance to prevent voltage breakdown between the conductors.

Figure 9:
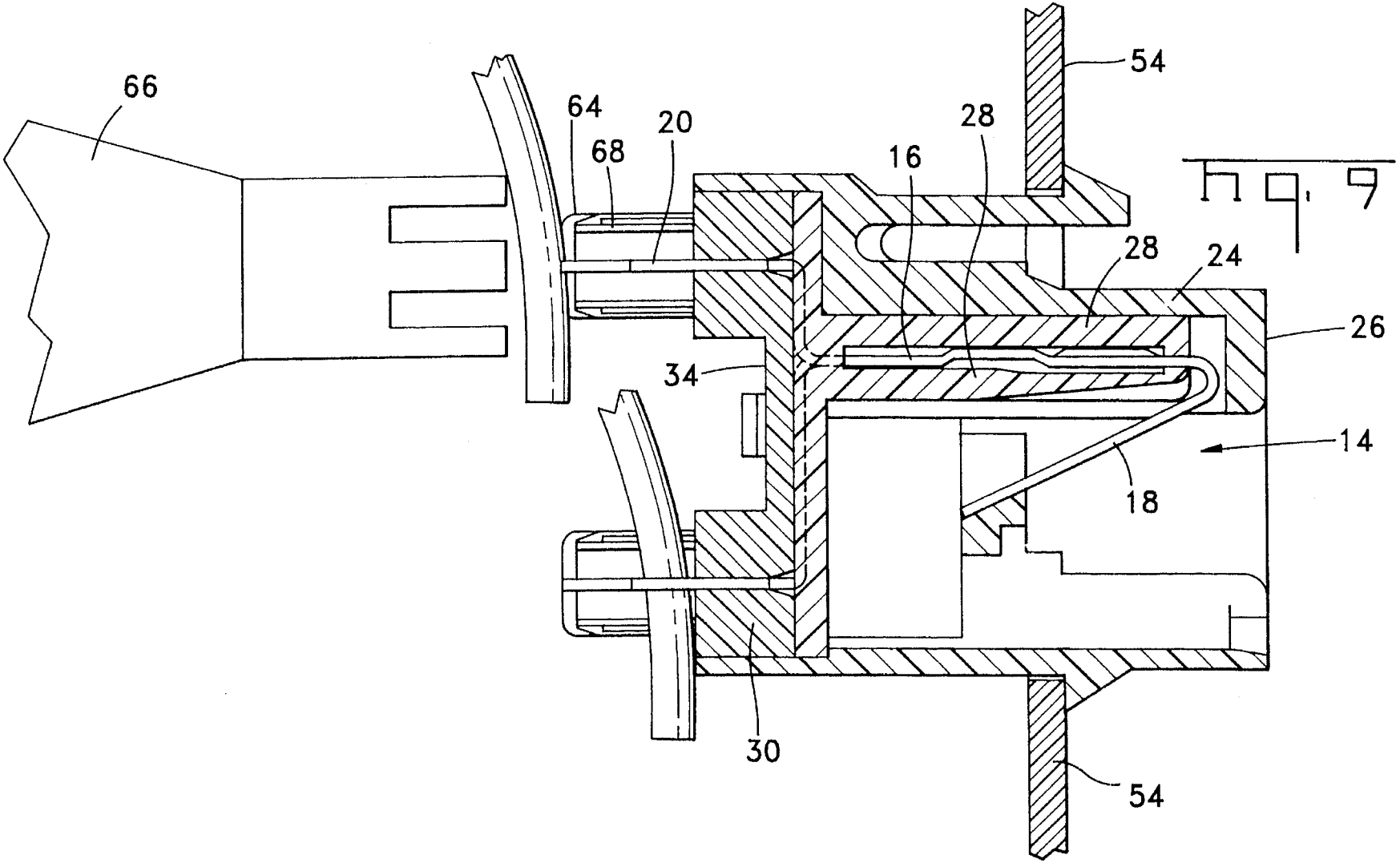
FIG. 9 is a greatly enlarged, fragmentary cross-sectional view of an electrical connector according to the present invention illustrating the insertion of a conductor into an insulation displacement slot with an impact tool.
Figures 10, 11:
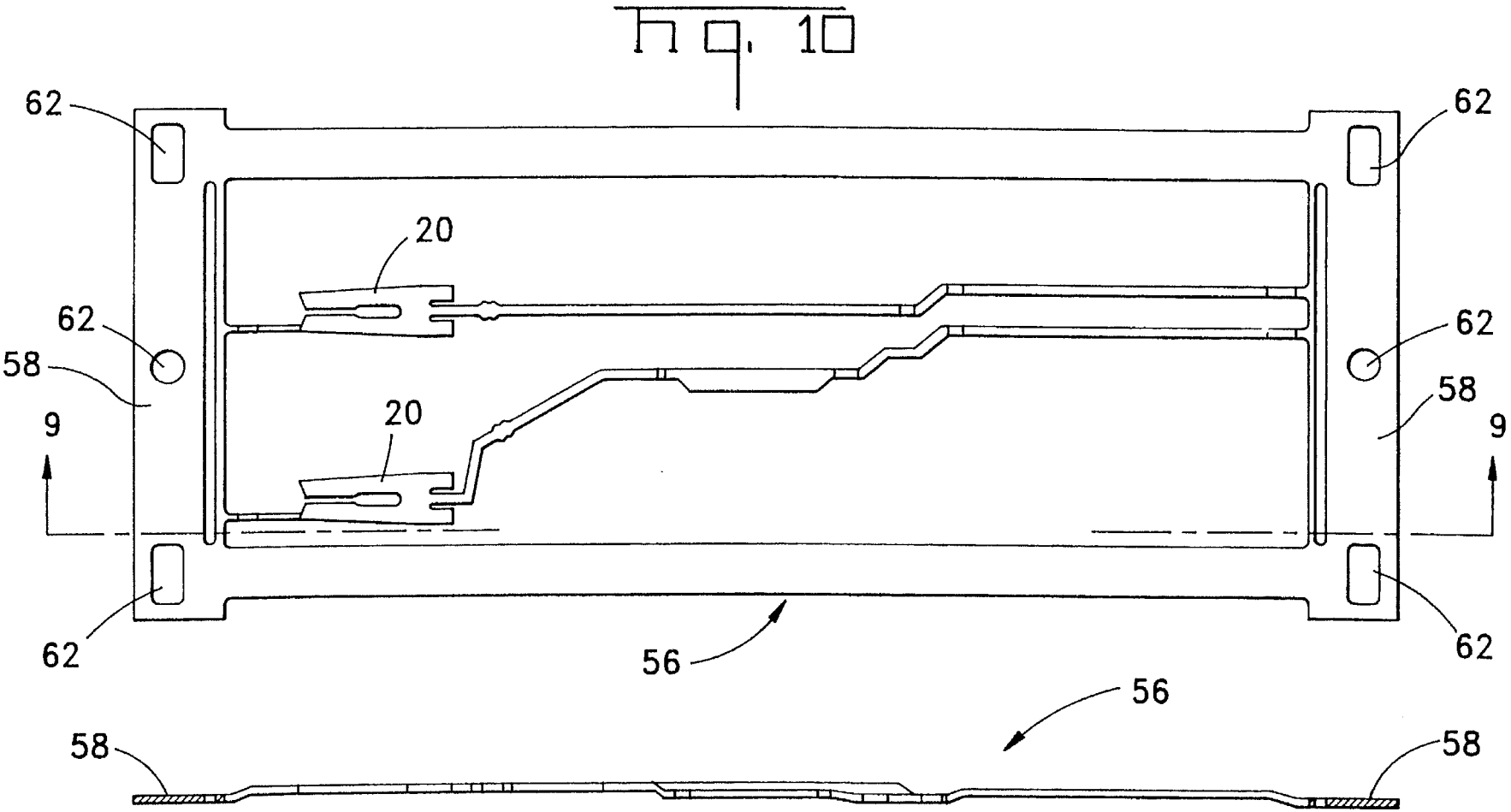
FIG. 10 is a plan view of the upper lead frame of the lead frame assembly illustrated in FIG. 5.
FIG. 11 is a cross-sectional side view of the upper lead frame of FIG. 10.
Figures 12, 13:
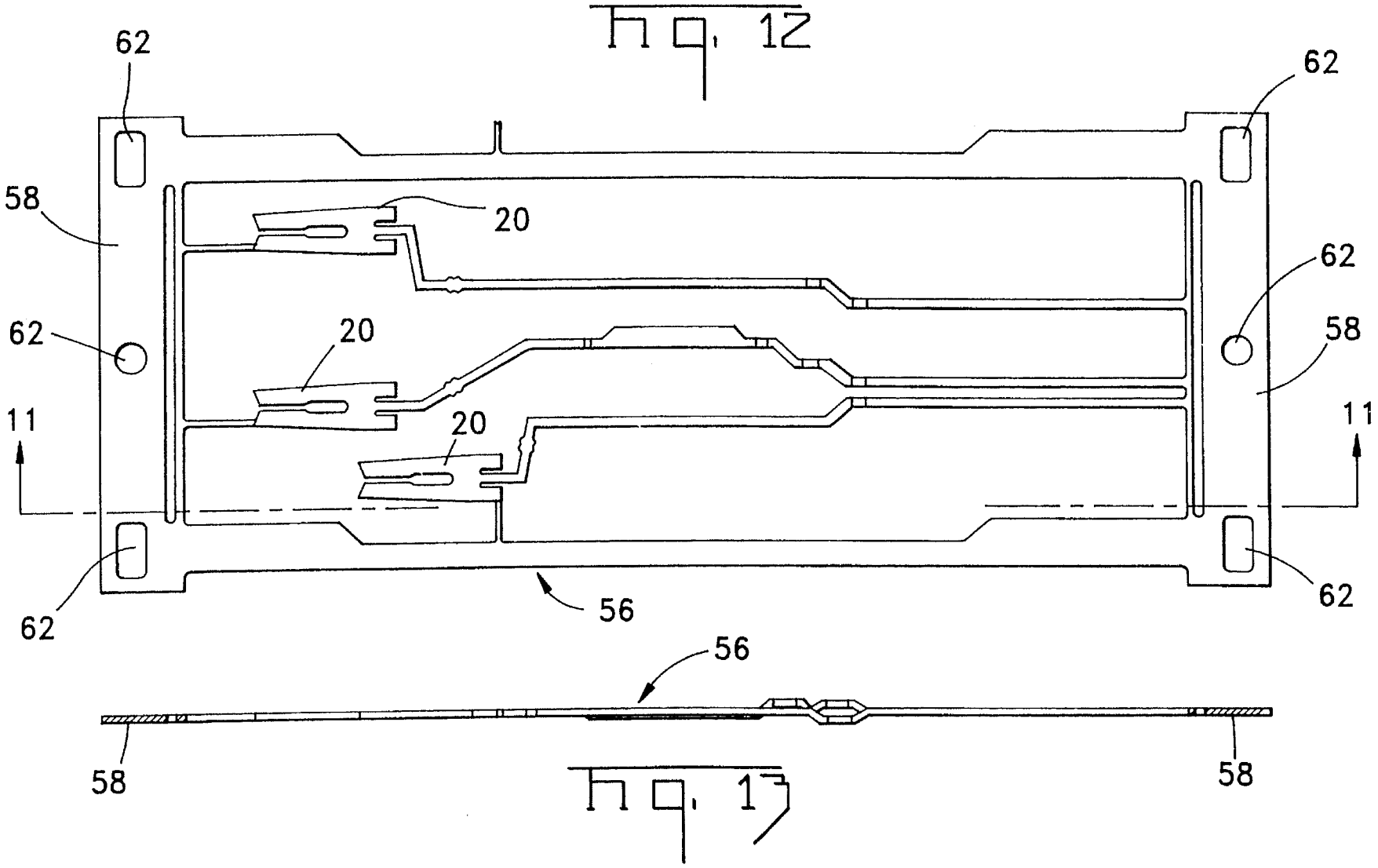
FIG. 12 is a plan view of the middle lead frame of the lead frame assembly illustrated in FIG. 5.
FIG. 13 is a cross-sectional side view of the middle lead frame of FIG. 10.
Figure 14:
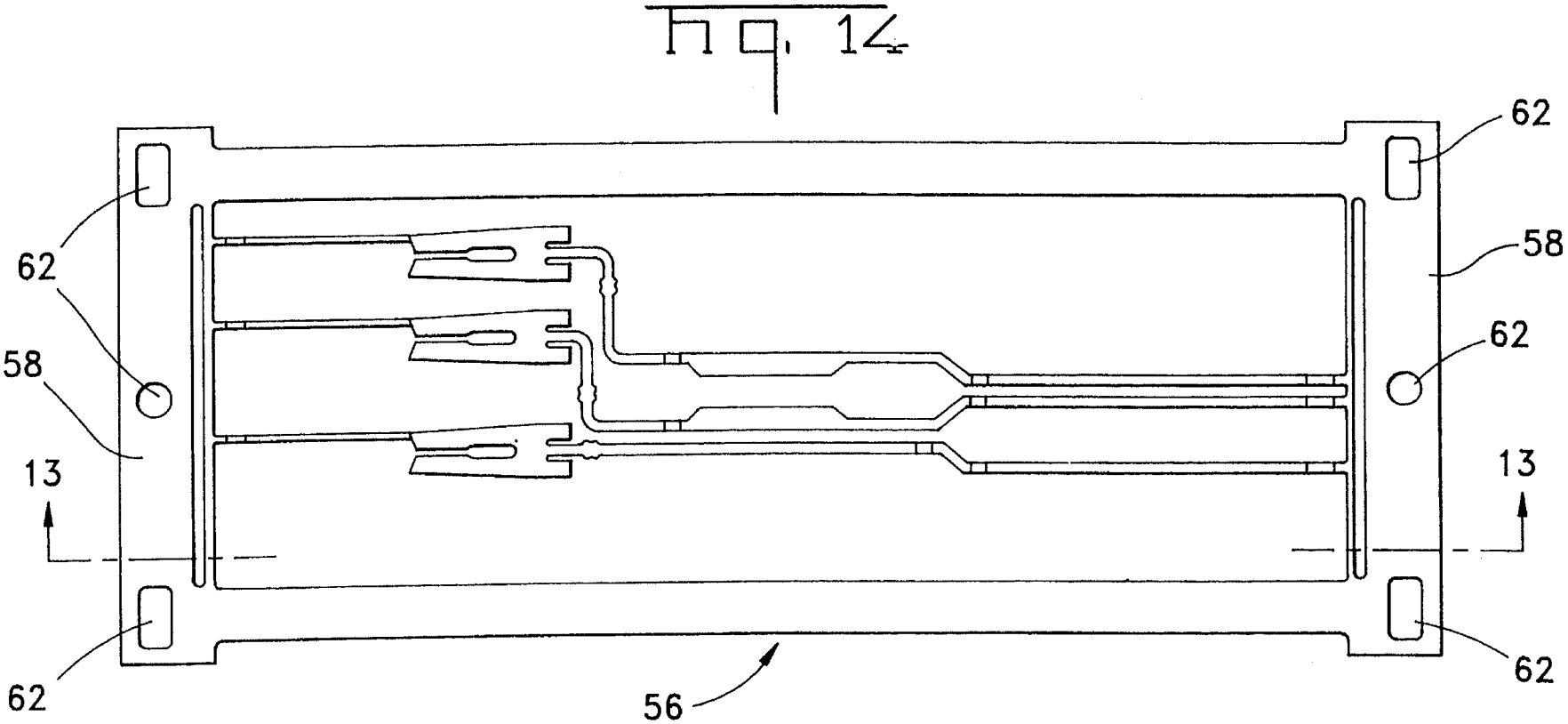
FIG. 14 is a plan view of the lower lead frame of the lead frame assembly illustrated in FIG. 5.
Figure 15:
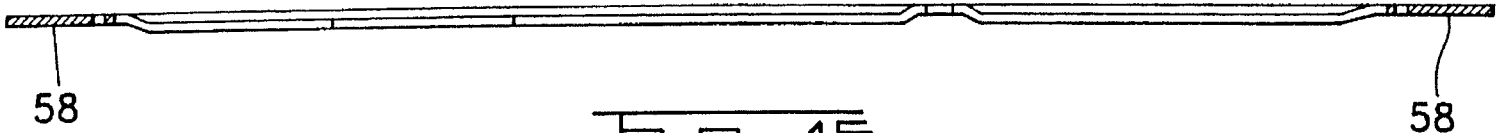
FIG. 15 is a cross-sectional side view of the lower lead frame of FIG. 10.

As illustrated in FIG. 9, the electrical connector 10, such as the modular telephone jack of the illustrated embodiment, is adapted to be mounted in a wall plate or face plate 54 which can thereafter be mounted in a wall or other supporting structure to complete the insulation. Although not illustrated, a modular plug can be inserted into the opening 14 defined in the front surface 26 of the housing 12 of the electrical connector to establish electrical connection between a telecommunications device (not shown) and the multi-conductor cable, via the electrical connector.

As known to those skilled in the art, the modular plug generally includes a plurality of conductive elements arranged in a predetermined order and adapted for electrical connection with predetermined conductors of the multi-conductor cable. Accordingly, the respective first ends of the plurality of elongate conductors 16 of the electrical connector 10 of the present invention are preferably arranged in a first predetermined order such that each conductive element of the modular plug deflects and thereby electrically contacts the resilient contact portion 18 of a predetermined conductor.

In addition, the second ends of the plurality of elongate conductors 16 of the electrical connector 10 are preferably arranged in a second predetermined order. As known to those skilled in the art, the conductors of the multi-conductor cable, such as a telecommunications cable, are generally arranged in pairs which are twisted to reduce crosstalk between the conductors. Therefore, the second predetermined order of the respective second ends of the elongate conductors is preferably arranged such that each conductor of a conductor pair of the multi-conductor cable is inserted in an adjacent insulation displacement slot 22. Accordingly, the twisted conductor pairs of the multi-conductor cable can remain twisted to a location very near the insulation displacement contact portions 20 so as to further decrease crosstalk between the conductors of the multi-conductor cable. In addition, by terminating each conductor of a twisted conductor pair in an adjacent insulation displacement slot, a technician installing the electrical connector and inserting the conductors of the multi-conductor cable into the respective insulation displacement slots can readily insert the conductor therein. Further, both the conductors and the portions of the housing 12 surrounding the respective apertures 32 are preferably color-coded to further facilitate wiring of the electrical connector 10.

As illustrated in FIG. 5, at least one of the plurality of elongate conductors 16 laterally crosses another of the plurality conductors at a location between the crossover location 49 and the second end of the at least one connector. The conductors laterally cross between the crossover location and their respective second ends so that the respective second ends of the plurality connectors are arranged in the second predetermined order.

As illustrated in FIGS. 5–7, the plurality of elongate conductors 16 are preferably fabricated from a plurality of lead frames 56 of a lead frame assembly 46. Each lead frame preferably includes at least one elongate conductor extending from a first end connected to a first side 58 of the lead frame to a second end connected to a second side of the lead frame 60, opposite the first side. In addition, the lead frame assembly preferably includes alignment means, such as a plurality of aligned apertures 62 defined by each lead frame, for aligning the plurality of lead frames. The lead frames are preferably aligned such that the conductors of the plurality of lead frames include at least one pair of conductors which laterally cross at the predetermined crossover location 49 and at least one pair of conductors which includes compensating segments 48 arranged in an overlapping, vertically spaced relationship as described hereinabove.

As illustrated in FIGS. 10–15, the lead frame assembly 46 of the illustrated embodiment includes three lead frames 56 which each include a plurality of elongate conductors 16. As shown in FIGS. 6 and 7, the three lead frames are stacked so as to include upper, middle and lower lead frames. The upper, middle and lower lead frames are illustrated in more detail in top plan views in FIGS. 10, 12 and 14, respectively, and in cross-sectional side views in FIGS. 11, 13 and 15, respectively. It will be apparent, however, that the lead frame assembly can include any number of lead frames without departing from the spirit and scope of the present invention.

According to one embodiment of the present invention, the elongate conductors 16 of the electrical connector 10 are comprised of a phosphorous bronze copper alloy material. More particularly, the plurality of lead frames 56, including the plurality of elongate conductors, can be stamped from a sheet of bronze material which is coated with a layer of phosphorous. The plurality of lead frames can also be coated with an insulating coating, such as polyvinyl formal or polyamide/polyimide, to further prevent electrical contact between the plurality of elongate conductors. The lead frames can then be aligned, such as by aligning the apertures 62 defined by each lead frame, and the first and second supporting members 28 can be positioned on opposite sides of the plurality lead frames. The frame portion of the plurality of lead frames can then be removed and the remaining elongate conductors folded about the first and second supporting members as described hereinabove and as illustrated in FIG. 4.

As illustrated in FIGS. 1–4, the strain relief cap 30 of the housing 12 preferably includes a plurality of outwardly projected silos 64. The silos extend laterally rearwardly from the rear surface 34 of the housing and are positioned to project outwardly from portions of the rear surface between the plurality of apertures 32 defined therein. Due to the rearward projection of the silos, the insulation displacement contact portion 20 of each of the plurality of conductors 16 which extend through a respective aperture 32 defined in the rear surface of the housing extends between a pair of adjacent silos. Accordingly, a conductor of the multi-conductor cable can be inserted into the insulation displacement slot 22 by application of a forwardly directed force to the wire, that is, a force directed generally in a direction from the rear surface of the housing toward the front surface of the housing as shown in FIG. 9. Each silo can be color-coded to match the color-coding of the conductor of the multi-conductor cable further simplifying installation and wiring of the electrical connector.

The requisite insertion force is typically provided by an impact tool 66, such as those manufactured and sold by AT&T and Krone which bear Product Nos. Harris-Dracon D-814 and LSA-PLUS #6417 2 055-01, respectively. As known to those skilled in the art, impact tools not only apply the force necessary to insert a conductor 16 into an insulation displacement slot 22 defined by an insulation displacement contact portion 22, but also simultaneously terminate the inserted conductor. The silos 64 are preferably sized and shaped to receive either the impact tool manufactured by either AT&T or Krone. In addition, each silo preferably extends rearwardly beyond the insulation displacement contact portions to separate and protect the insulation displacement contact portions. The portions of the silos which extends rearwardly beyond the insulation displacement contact portions provide a surface against which the impact tool can seat to thereby further protect the insulation displacement contact portions.

By inserting the conductors 16 into the respective insulation displacement slots 22 with a forwardly directed force, the conductors 13 can be inserted after the electrical connector 10 has been mounted in a wall plate 54 as shown in FIG. 9. Thus, the installation of the electrical connector is simplified since the electrical connector need no longer be handled after the conductors have been inserted into the insulation displacement slots. In addition, in many instances it is desirable to re-wire or change the wiring pattern of a particular outlet so as to provide different or additional telecommunications features. According to the present invention, the wall plate can be removed and, with the electrical connector installed therein, withdrawn from the wall. Thereafter, the connection of the individual conductors to the insulation displacement slots of the electrical connector can be revised as desired without removing the electrical connector from the wall plate. Accordingly, wiring and re-wiring of the electrical connector is simplified by the method and apparatus of the present invention.

As illustrated in FIGS. 2 and 3, each silo 64 preferably includes at least one rib 68 projecting laterally outwardly from each side of the silo. The ribs serve to guide the conductors 16 into the insulation displacement slots 22 defined by the opposed blade portions of the insulation displacement contact portions 20. In one embodiment, first and second ribs project laterally outward from portions of the side surfaces of the silo which are separated by the insulation displacement contact portions. For example, in the illustrated embodiment, a first rib projects laterally outward from a portion of the side surface of the silo which is above the insulation displacement contact portion while a second rib projects laterally outward from a portion of the side surface of the silo which is below the insulation displacement contact portion. The outwardly projecting ribs can also be sized to frictionally engage the conductor. Accordingly, the friction engagement of the conductor restricts movement in the connector and reduces, if not eliminates, strain on the conductor, thereby improving the performance and service lifetime of the conductors.

In the drawings and specifications, there has been set forth a preferred embodiment of the invention, and although specific terms are employed, they are used in generic and descriptive sense only and not for purpose of limitation.

That which is claimed is:

1. An electrical connector comprising:

a housing defining a cavity which opens through a front surface of said housing, said housing comprising a rear surface, opposite the front surface, defining a plurality of apertures extending therethrough; and a plurality of elongate conductors positioned at least partially within the cavity defined within said housing, each of said conductors having a resilient contact portion at a first end and an insulation displacement contact portion at a second end, opposite the first end, extending through an aperture defined in the rear surface of said housing, each of said conductors having a respective substantially constant width, wherein said plurality of conductors include first and second elongate conductors which extend in a substantially parallel, laterally spaced relationship from their respective first ends to a predetermined crossover location where the first and second conductors laterally cross without establishing electrical contact therebetween, and wherein each conductor of a laterally spaced-apart pair of said conductors has a respective portion which is wider than its said substantially constant width, and said wider portions are positioned in an overlapping, vertically spaced relationship at a predetermined location spaced apart from the crossover location to compensate for crosstalk between said plurality of conductors.

2. An electrical connector according to claim 1 wherein said plurality of elongate conductors extend in a substantially parallel, laterally spaced relationship from their respective first ends to respective crossover locations where each conductor crosses an adjacent conductor without establishing electrical contact therebetween.

3. An electrical connector according to claim 2 wherein distances defined by each of said conductors between their respective said crossover locating and their respective first and second ends, respectively, are equal.

4. An electrical connector according to claim 2 wherein first and second pairs of said laterally spaced-apart conductors have said wider portions which are positioned in respective overlapping, vertically spaced relationships at predetermined locations between the crossover location and the second ends of their respective conductors, and wherein said first and second pairs of said conductors are the laterally innermost conductors.

5. An electrical connector according to claim 1 wherein portions of said first and second conductors are coated with an insulating coating at the predetermined crossover location.

6. An electrical connector according to claim 1 wherein said wider portions are coated with an insulating coating to thereby minimize a required vertical spacing therebetween.

7. An electrical connector according to claim 1 wherein the respective first ends of said plurality of conductors are arranged in a first predetermined order, and wherein at least one of said plurality of conductors laterally crosses another of said plurality of conductors at a location between the crossover location and the second end of said at least one conductor such that the respective second ends of said plurality of conductors are arranged in a second predetermined order.

8. An electrical connector according to claim 1 wherein said housing further comprises a plurality of outwardly projecting silos extending rearwardly from the rear surface wherein said plurality of silos are positioned to project outwardly from portions of the rear surface between the plurality of apertures defined therein, and wherein said insulation displacement contact portion of each of said plurality of conductors, which extends through a respective aperture defined in the rear surface of said housing and between a pair of adjacent said silos, includes a pair of opposed blade portions defining an insulation displacement slot therebetween such that a wire can be inserted into the insulation displacement slot by application of a forwardly directed force to the wire.

9. An electrical connector according to claim 8 wherein the plurality of apertures defined in said housing are arranged in two laterally extending spaced-apart rows.

10. An electrical connector comprising a plurality of elongate conductors each having a respective predetermined width, wherein each conductor has a resilient contact portion at a first end and an insulation displacement contact portion at a second end, opposite the first end, wherein said conductors are associated in pairs and said conductors extend in a substantially parallel, laterally spaced relationship from their respective first ends to a predetermined crossover location where one conductor of each said pair laterally crosses the other conductor of each said pair without establishing electrical contact therebetween, and wherein each said pair includes first and second conductors having respective compensating segments each having a respective width, which is greater than its said predetermined width the compensating segments of each said pair being overlapped in a vertically spaced relationship at a predetermined location spaced apart from the crossover location to compensate for crosstalk between said plurality of conductors.

11. An electrical connector according to claim 10 wherein distances defined by each of said conductors between their respective said crossover locations and their respective first and second ends, respectively, are equal.

12. An electrical connector according to claim 10 wherein portions of said first and second conductors are coated with an insulating coating at the predetermined crossover location.

13. An electrical connector according to claim 10 wherein said wider portions are coated with an insulating coating to thereby minimize a required vertical spacing therebetween.

14. An electrical connector according to claim 10 wherein the respective first ends of said plurality of conductors are arranged in a first predetermined order, and wherein at least one of said plurality of conductors laterally crosses another of said plurality of conductors at a location between the crossover location and the second end of said at least one conductor such that the respective second ends of said plurality of conductors are arranged in a second predetermined order.

15. A lead frame comprising:

a plurality of lead frames wherein each lead frame includes at least one elongate conductor extending from a first end connected to a first side of said lead frame to a second end connected to a second side of said lead frame, opposite the first side, and wherein each said elongate conductor has a respective substantially constant width and includes a resilient contact portion at the first end and an insulation displacement contact portion at the second end; and alignment means for aligning said plurality of lead frames such that the conductors of said plurality of lead frames include first and second elongate conductors which extend in a substantially parallel, laterally spaced relationship from the respective first ends to a predetermined crossover location where the first and second conductors laterally cross without establishing electrical contact therebetween, and such that each conductor of a laterally spaced-apart pair of the conductors has a respective portion which is wider than its said substantially constant width, and said wider portions are positioned in an overlapping, vertically spaced relationship at a predetermined location spaced apart from the crossover location to compensate for crosstalk between the conductors.

16. A lead frame assembly according to claim 15 wherein distances defined by each of the conductors of said plurality of lead frames between their respective said crossover locations and their respective first and second ends, respectively, are equal.

17. A lead frame assembly according to claim 15 wherein said alignment means aligns said plurality of lead frames such that the elongate conductors extend in a substantially parallel, laterally spaced relationship from their respective first ends to respective crossover locations where each conductor crosses an adjacent conductor without establishing electrical contact therebetween.

18. A lead frame assembly according to claim 15 wherein each of said plurality of lead frames is coated with an insulating coating.

19. A lead frame assembly according to claim 15 wherein the respective first ends of the conductors or said plurality of lead frames are arranged in a first predetermined order, and wherein at least one of the conductors laterally crosses another of the conductors at a location between the crossover location and the second end of the at least one conductor such that the respective second ends of the conductors are arranged in a second predetermined order.

20. A method of compensating for crosstalk between a plurality of conductors wherein each conductor has a respective substantially constant width, a resilient contact portion at a first end and an insulation displacement contact portion at a second end, opposite the first end, the method comprising the steps of:

extending the plurality of conductors in a substantially parallel, laterally spaced relationship form their respective first ends to a predetermined crossover location;

laterally crossing each said conductor with an adjacent said conductor without establishing electrical contact therebetween;

providing each conductor of a laterally spaced-apart pair of said conductors with a portion which is wider than its said substantially constant width; and overlapping said wider portions in a vertically spaced relationship at a predetermined location spaced apart from the crossover location to thereby compensate for crosstalk between the plurality of conductors.

21. A method according to claim 20 wherein said overlapping step comprises the step of capacitively coupling the vertically spaced wider portions of the pair of conductors.

22. A method according to claim 20 wherein the respective first ends of the plurality of conductors are arranged in a first predetermined order, the method further comprising the step of laterally crossing at least one of the plurality of conductors with another of the plurality of conductors at a location between the crossover location and the second end of the at least one conductor such that the respective second ends of the plurality of conductors are arranged in a second predetermined order.

23. A method according to claim 20 further comprising the steps of:

positioning the plurality of elongate conductors at least partially within a cavity defined within a housing and opening through a front surface of the housing, the housing including a rear surface, opposite the front surface, defining a plurality of apertures extending into the cavity defined therein, the housing also including a plurality of outwardly projecting silos extending rearwardly from the rear surface wherein the plurality of silos are positioned to project outwardly from portions of the rear surface between the plurality of apertures defined therein;

extending the insulation displacement contact portions of each of the plurality of conductors through a respective said aperture defined in the rear surface of the housing and between a pair of adjacent silos, wherein each said insulation displacement contact portion includes a pair of opposed blade poritons defining an insulation displacement slot therebetween; and inserting a wire into the insulation displacement slot by applying a force the wire that is directed forwardly from the rear surface of the housing to the front surface of the housing.

* * * * *